US006094187A

United States Patent [19]

Jones et al.

[11] Patent Number: 6,094,187

[45] Date of Patent: Jul. 25, 2000

[54] LIGHT MODULATING DEVICES HAVING GREY SCALE LEVELS USING MULTIPLE STATE SELECTION IN COMBINATION WITH TEMPORAL AND/OR SPATIAL DITHERING

[75] Inventors: John Clifford Jones, Malvern; Jonathan Rennie Hughes, St. John's, both of United Kingdom

[73] Assignees: Sharp Kabushiki Kaisha, Osaka, Japan; The Secretary of State for Defence in Her Britannic Majesty's Goverment of the United Kingdom of Great Britain and Northern Ireland, Hants, United Kingdom

[21] Appl. No.: 08/990,030

[22] Filed: Dec. 15, 1997

[30] Foreign Application Priority Data

Dec. 16, 1996 [GB] United Kingdom ..... 9626104
May 20, 1997 [GB] United Kingdom ..... 9710404

[51] Int. Cl.[7] ..... G09G 5/10
[52] U.S. Cl. ..... 345/147
[58] Field of Search ..... 345/147–149

[56] References Cited

U.S. PATENT DOCUMENTS

| | | | |
|---|---|---|---|
| 5,068,649 | 11/1991 | Garrett | 345/89 |
| 5,619,228 | 4/1997 | Doherty | 345/147 |
| 5,703,621 | 12/1997 | Martin et al. | 345/89 |
| 5,767,828 | 6/1998 | McKnight | 345/89 |
| 5,805,126 | 9/1998 | Bassetti | 345/89 |
| 5,818,405 | 10/1998 | Eglit et al. | 345/147 |
| 5,905,482 | 5/1999 | Hughes et al. | 345/89 |

OTHER PUBLICATIONS

P. Maltese, Mol. Cryst. Liq. Cryst. 1992, vol. 215, pp. 57–72, "Advances and Problems in the Development of Ferroelectric Liquid Crystal Display".

K–F. Reinhart, et al., Ferroelectrics, 1991, vol. 113, pp. 405–417, "Addressing of Ferroelectric Liquid Crystal Matrices and Electrooptical Characterization".

W.J.A.M. Hartman, Ferroelectrics, 1991, vol. 122, pp. 1–26, "Ferroelectric Liquid Crystal Displays for Television Application".

*Primary Examiner*—Mark R. Powell
*Assistant Examiner*—Anthony J. Blackman
*Attorney, Agent, or Firm*—Renner Otto Boisselle & Sklar

[57] ABSTRACT

A ferroelectric liquid crystal display comprises an addressable matrix of pixels, and addressing circuitry for selectively addressing each pixel in order to vary the transmission level of the pixel relative to the transmission levels of the other pixels. The addressing circuitry includes spatial and/or temporal dither circuits for addressing separately addressable subpixels with different spatial dither signals and/or for addressing each pixel or subpixel with different temporal dither signals in separate subframes. In addition to such spatial and/or temporal dither, the addressing circuitry switches each pixel or subpixel between different grey states corresponding to different transmission levels, with at least two of the bits of spatial or temporal dither being switchable between more than two different grey states and at least one bit being switchable between a lesser number of different grey states than the or each other bit, so that a plurality of different overall transmission levels are achievable by different combinations of spatial and/or temporal dither and such grey states. This allows a larger number of substantially linearly spaced or suitably weighted grey levels to be produced than has previously been possible without giving rise to unacceptable complications.

17 Claims, 16 Drawing Sheets

| 4 | 2 | 1 | TOTAL |
|---|---|---|---|
| 0 | 0 | 0 | 0 |
| 0 | 0 | 1 | 1 |
| 0 | 1 | 0 | 2 |
| 0 | 1 | 1 | 3 |
| 1 | 0 | 0 | 4 |
| 1 | 0 | 1 | 5 |
| 1 | 1 | 0 | 6 |
| 1 | 1 | 1 | 7 |

| 16 | 2 | 1 | TOTAL |
|---|---|---|---|
| 0 | 0 | 0 | 0 |
| 0 | 0 | 1 | 1 |
| 0 | 1 | 0 | 2 |
| 0 | 1 | 1 | 3 |
| 0.25 | 0 | 0 | 4 |
| 0.25 | 0 | 1 | 5 |
| 0.25 | 1 | 0 | 6 |
| 0.25 | 1 | 1 | 7 |
| 0.5 | 0 | 0 | 8 |
| 0.5 | 0 | 1 | 9 |
| 0.5 | 1 | 0 | 10 |
| 0.5 | 1 | 1 | 11 |
| 0.75 | 0 | 0 | 12 |
| 0.75 | 0 | 1 | 13 |
| 0.75 | 1 | 0 | 14 |
| 0.75 | 1 | 1 | 15 |
| 1 | 0 | 0 | 16 |
| 1 | 0 | 1 | 17 |
| 1 | 1 | 0 | 18 |
| 1 | 1 | 1 | 19 |

FIG 7

| n1=2 ( 0,1 ) | n2=3 ( 0,0.5,1 ) | n3=4 ( 0,0.33,0.67,1 ) | Grey Level |
|---|---|---|---|
| 1 | 4 | 18 | |
| 0 | 0 | 0 | 0+0+0 = 0 |
| 1 | 0 | 0 | 1+0+0 = 1 |
| 0 | 0.5 | 0 | 0+2+0 = 2 |
| 1 | 0.5 | 0 | 1+2+0 = 3 |
| 0 | 1 | 0 | 0+4+0 = 4 |
| 1 | 1 | 0 | 1+4+0 = 5 |
| 0 | 0 | 0.33 | 0+0+6 = 6 |
| 1 | 0 | 0.33 | 1+0+6 = 7 |
| 0 | 0.5 | 0.33 | 0+2+6 = 8 |
| 1 | 0.5 | 0.33 | 1+2+6 = 9 |
| 0 | 1 | 0.33 | 0+4+6 = 10 |
| 1 | 1 | 0.33 | 1+4+6 = 11 |
| 0 | 0 | 0.67 | 0+0+12 = 12 |
| 1 | 0 | 0.67 | 1+0+12 = 13 |
| 0 | 0.5 | 0.67 | 0+2+12 = 14 |
| 1 | 0 .5 | 0.67 | 1+2+12 = 15 |
| 0 | 1 | 0.67 | 0+4+12 = 16 |
| 1 | 1 | 0.67 | 1+4+12 = 17 |
| 0 | 0 | 1 | 0+0+18 = 18 |
| 1 | 0 | 1 | 1+0+18 = 19 |
| 0 | 0.5 | 1 | 0+2+18 = 20 |
| 1 | 0.5 | 1 | 1+2+18 = 21 |
| 0 | 1 | 1 | 0+4+18 = 22 |
| 1 | 1 | 1 | 1+4+18 = 23 |

FIG 8

| $n_1 = 4$ (0,0.33,0.67,1) | $n_2 = 3$ (0,0.5,1) | $n_3 = 2$ (0,1) | Grey level |
|---|---|---|---|
| 3 | 8 | 12 | |
| 0 | 0 | 0 | 0+0+0=0 |
| 0.33 | 0 | 0 | 1+0+0=1 |
| 0.67 | 0 | 0 | 2+0+0=2 |
| 1 | 0 | 0 | 3+0+0=3 |
| 0 | 0.5 | 0 | 0+4+0=4 |
| 0.33 | 0.5 | 0 | 1+4+0=5 |
| 0.67 | 0.5 | 0 | 2+4+0=6 |
| 1 | 0.5 | 0 | 3+4+0=7 |
| 0 | 1 | 0 | 0+8+0=8 |
| 0.33 | 1 | 0 | 1+8+0=9 |
| 0.67 | 1 | 0 | 2+8+0=10 |
| 1 | 1 | 0 | 3+8+0=11 |
| 0 | 0 | 1 | 0+0+12=12 |
| 0.33 | 0 | 1 | 1+0+12=13 |
| 0.67 | 0 | 1 | 2+0+12=14 |
| 1 | 0 | 1 | 3+0+12=15 |
| 0 | 0.5 | 1 | 0+4+12=16 |
| 0.33 | 0.5 | 1 | 1+4+12=17 |
| 0.67 | 0.5 | 1 | 2+4+12=18 |
| 1 | 0.5 | 1 | 3+4+12=19 |
| 0 | 1 | 1 | 0+8+12=20 |
| 0.33 | 1 | 1 | 1+8+12=21 |
| 0.67 | 1 | 1 | 2+8+12=22 |
| 1 | 1 | 1 | 3+8+12=23 |

FIG 9

FIG 10

| n1=3 | n2=3 | n3=2 | n4=2 | n5=2 | n6=2 | Number of levels in each bit |
|---|---|---|---|---|---|---|
| ( 0,1,2 ) | ( 0,3,6 ) | ( 0,9 ) | ( 0,18) | ( 0,36 ) | ( 0,72 ) | ( levels ) |
| 2 | 6 | 9 | 18 | 18 | 72 | Digital Weighting |
| | | | | | | Resultant Grey Levels |
| 0,1,2 | 0 | 0 | 0 | 0 | 0 | 0,1,2 |
| 0,1,2 | 3 | 0 | 0 | 0 | 0 | 3,4,5 |
| 0,1,2 | 6 | 0 | 0 | 0 | 0 | 6,7,8 |
| 0,1,2 | 0 | 9 | 0 | 0 | 0 | 9,10,11 |
| 0,1,2 | 3 | 9 | 0 | 0 | 0 | 12,13,14, |
| 0,1,2 | 6 | 9 | 0 | 0 | 0 | 15,16,17 |
| 0,1,2 | 0 | 0 | 18 | 0 | 0 | 18,19,20 |
| 0,1,2 | 3 | 0 | 18 | 0 | 0 | 21,22,23 |
| 0,1,2 | 6 | 0 | 18 | 0 | 0 | 24,25,26 |
| 0,1,2 | 0 | 9 | 18 | 0 | 0 | 27,28,29 |
| 0,1,2 | 3 | 9 | 18 | 0 | 0 | 30,31,32, |
| 0,1,2 | 6 | 9 | 18 | 0 | 0 | 33,34,35 |
| 0,1,2 | 0 | 0 | 0 | 36 | 0 | 36,37,38 |
| 0,1,2 | 3 | 0 | 0 | 36 | 0 | 39,40,41 |
| 0,1,2 | 6 | 0 | 0 | 36 | 0 | 42,43,44 |
| 0,1,2 | 0 | 9 | 0 | 36 | 0 | 45,46,47 |
| 0,1,2 | 3 | 9 | 0 | 36 | 0 | 48,49,50 |
| 0,1,2 | 6 | 9 | 0 | 36 | 0 | 51,52,53 |
| 0,1,2 | 0 | 0 | 18 | 36 | 0 | 54,55,56 |
| 0,1,2 | 3 | 0 | 18 | 36 | 0 | 57,58,59 |
| 0,1,2 | 6 | 0 | 18 | 36 | 0 | 60,61,62 |
| 0,1,2 | 0 | 9 | 18 | 36 | 0 | 63,64,65 |
| 0,1,2 | 3 | 9 | 18 | 36 | 0 | 66,67,68 |
| 0,1,2 | 6 | 9 | 18 | 36 | 0 | 69,70,71 |
| 0,1,2 | 0 | 0 | 0 | 0 | 72 | 72,73,74 |
| 0,1,2 | 3 | 0 | 0 | 0 | 72 | 75,76,77 |
| 0,1,2 | 6 | 0 | 0 | 0 | 72 | 78,79,80 |
| 0,1,2 | 0 | 9 | 0 | 0 | 72 | 81,82,83 |
| 0,1,2 | 3 | 9 | 0 | 0 | 72 | 84,85,86 |
| 0,1,2 | 6 | 9 | 0 | 0 | 72 | 87,88,89 |
| 0,1,2 | 0 | 0 | 18 | 0 | 72 | 90,91,92 |
| 0,1,2 | 3 | 0 | 18 | 0 | 72 | 93,94,95 |
| 0,1,2 | 6 | 0 | 18 | 0 | 72 | 96,97,98 |
| 0,1,2 | 0 | 9 | 18 | 0 | 72 | 99,100,101 |
| 0,1,2 | 3 | 9 | 18 | 0 | 72 | 102,103,104 |
| 0,1,2 | 6 | 9 | 18 | 0 | 72 | 105,106,107 |
| 0,1,2 | 0 | 0 | 0 | 36 | 72 | 108,109,110 |
| 0,1,2 | 3 | 0 | 0 | 36 | 72 | 111,112,113, |
| 0,1,2 | 6 | 0 | 0 | 36 | 72 | 114,115,116 |
| 0,1,2 | 0 | 9 | 0 | 36 | 72 | 117,118,119 |
| 0,1,2 | 3 | 9 | 0 | 36 | 72 | 120,121,122 |
| 0,1,2 | 6 | 9 | 0 | 36 | 72 | 123,124,125 |
| 0,1,2 | 0 | 0 | 18 | 36 | 72 | 126,127,128 |
| 0,1,2 | 3 | 0 | 18 | 36 | 72 | 129,130,131 |
| 0,1,2 | 6 | 0 | 18 | 36 | 72 | 132,133,134 |
| 0,1,2 | 0 | 9 | 18 | 36 | 72 | 135,136,137 |
| 0,1,2 | 3 | 9 | 18 | 36 | 72 | 138,139,140 |
| 0,1,2 | 6 | 9 | 18 | 36 | 72 | 141,142,143 |
| | | | | | | |

| SD: | 1 | 2 |
|---|---|---|
| TD: 1 (2) | 0,1 | 0,2 |
| 4 (2) | 0,4 | 0,8 |
| 80 (6) | 0, 16, 32, 48, 64, 80 | 0, 32, 64, 96, 128, 160 |

FIG 11

256 levels

| SD: | 1 | 2 |
|---|---|---|
| TD: 1 (2) | 0,1 | 0,2 |
| 20 (6) | 0, 4, 8, 12, 16, 20 | 0, 8, 16, 24, 32, 40 |
| 64 (2) | 0, 64 | 0, 128 |

FIG 12

256 levels

| SD rows | 1 | 2 |
|---|---|---|
| SD columns: 5 (6) | 0, 1, 2, 3, 4, 5 | 0,2, 4, 6, 8, 10 |
| 16(2) | 0, 16 | 0, 32 |
| 64 (2) | 0, 64 | 0, 128 |

FIG 13

256 levels

| SD: | 1 | 2 |
|---|---|---|
| TD: 1 (2) | 0, 1 | 0,2 |
| 8 (3) | 0, 4, 8 | 0, 8, 16 |
| 84 (4) | 0, 28, 56, 84 | 0, 56, 112, 168 |

FIG 14

280 levels

| SD: | 1 | 2 |
|---|---|---|
| TD: 1 (2) | 0, 1 | 0,2 |
| 12 (4) | 0, 4, 8, 12 | 0, 8, 16, 24 |
| 80 (3) | 0, 40, 80 | 0, 80, 160 |

FIG 15

280 levels

| SD: | 1 | 2 |
|---|---|---|
| TD: 2 (3) | 0, 1, 2 | 0,2, 4 |
| 21 (4) | 0, 7, 14, 21 | 0, 14, 28, 42 |
| 70 (2) | 0, 70 | 0, 140 |

FIG 16

280 levels

| SD: | 1 | 2 |
|---|---|---|
| TD: 3 (4) | 0, 1, 2, 3 | 0, 2, 4, 6 |
| 10 (2) | 0, 10 | 0, 20 |
| 80 (3) | 0, 40, 80 | 0, 80, 160 |

FIG 17

280 levels

| SD row: | 1 | 2 |
|---|---|---|
| SD column: 3 (4) | 0, 1, 2, 3 | 0, 2, 4, 6 |
| 20 (3) | 0, 10, 20 | 0, 20, 40 |
| 70 (2) | 0, 70 | 0, 140 |

FIG 18

280 levels

| SD: | 1 | 2 |
|---|---|---|
| TD: 1 (2) | 0, 1 | 0, 2 |
| 8 (3) | 0, 4, 8 | 0, 8, 16 |
| 75 (4) | 0, 25, 50, 75 | 0, 50, 100, 150 |

FIG 19

253 levels

| SD: | 1 | 2 |
|---|---|---|
| TD: 2 (3) | 0, 1, 2 | 0, 2, 4 |
| 7 (2) | 0, 7 | 0, 14 |
| 56 (3) | 0, 28, 56 | 0, 56, 112 |

FIG 20

196 levels

| SD: | 1 | 2 |
|---|---|---|
| TD: 1 (2) | 0, 1 | 0, 2 |
| 8 (3) | 0,4, 8 | 0, 8, 16 |
| 56 (3) | 0, 28, 56 | 0, 56, 112 |

FIG 21

196 levels

| SD column: | 1 | 2 |
|---|---|---|
| SD row: 2 (3) | 0, 1, 2 | 0, 2, 4 |
| 14 (3) | 0, 7, 14 | 0, 14, 28 |
| 49 (2) | 0, 49 | 0, 98 |

FIG 22

196 levels

TD1 duration 1(2 levels)

| SD1: | 1 | 2 |
|---|---|---|
| SD2: 1 | 0, 1 | 0, 2 |
| 4 | 0, 4 | 0, 8 |

TD2 duration 32 (3 levels)

| SD1: | 1 | 2 |
|---|---|---|
| SD2: 1 | 0, 16, 32 | 0, 32, 64 |
| 4 | 0, 64, 128 | 0, 128, 256 |

496 levels

FIG 23

| SD: | 1 (2) | 4 (5) |
|---|---|---|
| TD: 1 | 0, 1 | 0, 1, 2, 3, 4 |
| 5 | 0, 5 | 0, 5, 10, 15, 20 |
| 25 | 0, 36 | 0, 36, 72, 108, 144 |

FIG 24

216 levels

| SD: | 4 (5) | 5 (2) |
|---|---|---|
| TD: 1 | 0, 1, 2, 3, 4 | 0, 5 |
| 10 | 0, 10, 20, 30, 40 | 0, 50 |
| 100 | 0, 100, 200, 300, 400 | 0, 500 |

FIG 25

1000 levels

| SD: | 2 (3) | 3 (2) |
|---|---|---|
| TD: 1 | 0, 1, 2 | 0, 3 |
| 6 | 0, 6, 12 | 0, 18 |
| 33 | 0, 33, 66 | 0, 99 |

FIG 26

201 levels

| SD: | 7 (8) | 8 (2) |
|---|---|---|
| TD: 1 | 0, 1, 2, 3, 4, 5, 6, 7 | 0, 8 |
| 16 | 0,16,32,48,64,80,96,112 | 0, 128 |

FIG 27

256 levels

| SD: | 1 | 3 |
|---|---|---|
| TD: 1 | 0, 1, 2 | 0, 1, 2 3, 4, 5, 6 |
| 9 | 0, 9, 18 | 0, 27, 54 |
| 20 | 0, 40 | 0, 120 |

FIG 28

241 levels

LIGHT MODULATING DEVICES HAVING GREY SCALE LEVELS USING MULTIPLE STATE SELECTION IN COMBINATION WITH TEMPORAL AND/OR SPATIAL DITHERING

BACKGROUND OF THE INVENTION

This invention relates to light modulating devices, and is concerned more particularly, but not exclusively, with liquid crystal display and optical shutter devices including spatial light modulators.

It should be understood that the term "light modulating devices" is used in this specification to encompass both light transmissive modulators, such as diffractive spatial modulators, or conventional liquid crystals displays, light emissive modulators, such as electroluminescent or plasma displays, reflective or transflective devices or displays, and other spatial light modulators, such as optically addressed spatial light modulators or plasma addressed spatial light modulators.

Liquid crystal devices are commonly used for displaying alphanumeric information and/or graphic images. Furthermore liquid crystal devices are also used as optical shutters, for example in printers. Such liquid crystal devices comprise a matrix of individually addressable modulating elements which can be designed to produce not only black and white, but also intermediate transmissive levels or "greys". Also, in colour devices, such as those employing colour filters, the intermediate levels may be used to give a wider variety of colours or hues. The so-called grey-scale response of such a device may be produced in a number of ways.

For example, the grey-scale response may be produced by modulating the transmission of each element between "on" and "off" states in dependence on the applied drive signal so as to provide different levels of analogue grey. In a twisted nematic device, for example, the transmission of each element may be determined by an applied RMS voltage and different levels of grey may be produced by suitable control of the voltage. In active matrix devices the voltage stored at the picture element similarly controls the grey level. On the other hand, it is more difficult to control the transmission in an analogue fashion in a bistable liquid crystal device, such as a ferroelectric liquid crystal device, although various methods have been reported by which the transmission may be controlled by modulating the voltage signal in such a device. In devices having no analogue greyscale, a greyscale response may be produced by so-called spatial or temporal dither techniques, or such techniques may be used to augment the analogue greyscale.

In a spatial dither (SD) technique each element is divided into two or more separately addressable subelements which are addressable by different combinations of switching signals in order to produce different overall levels of grey. For example, in the simple case of an element comprising two equal sized subelements each of which is switchable between a white state and a black state, three grey levels (including white and black) will be obtainable corresponding to both subelements being switched to the white state, both subelements being switched to the black state, and one subelement being in the white state while the other subelement is in the black state. Since both subelements are of the same size, the same grey level will be obtained regardless of which of the subelements is in the white state and which is in the black state, so that the switching circuit must be designed to take account of this level of redundancy. It is also possible for the subelements to be of different sizes which will have the effect that different grey levels will be produced depending on which of the two subelements is in the white state and which is in the black state. However a limit to the number of subelements which can be provided in practice is imposed by the fact that separate conductive tracks are required for supplying the switching signals to the subelements and the number of such tracks which can be accommodated is limited by space constraints, cost, fill factor or aperture ratio and the like.

In a temporal dither (TD) technique at least part of each element is addressable by different time modulated signals in order to produce different overall levels of grey within the addressing frame. For example, in a simple case in which an element is addressable within the frame by two subframes of equal duration, the element may be arranged to be in the white state when it is addressed so as to be "on" in both subframes, and the element maybe arranged to be in the dark state when it is addressed so as to be "off" in both subframes. Furthermore the element may be in an intermediate grey state when it is addressed so as to be "on" in one subframe and "off" in the other subframe. Furthermore it is possible to combine such a temporal dither technique with spatial dither by addressing one or more of the subelements in a spatial dither arrangement by different time modulated signals. This allows an increased range of grey levels to be produced at the cost of increased circuit complexity.

In many applications, and particularly in display devices for displaying moving graphic images, there is a requirement for a large number of suitably spaced grey levels to be generated, with minimum (preferably no) redundancy of grey levels. Usually the grey levels are linearly spaced as far as possible. To this end it has been proposed that the elements should be binary weighted, for example by dividing each element into three subelements having surface areas in the ratio 4:2:1 in an SD arrangement. In this case, assuming that each subelement is separately switchable between a black state corresponding to a unit grey level of 0 and a white state corresponding to a unit grey level of 1, and that the total grey level is given by adding together the grey levels of the three subelements with the appropriate binary weighting, 8 different grey levels without redundancy are obtainable by addressing of the three subelements concurrently as shown in FIG. 6.

European Patent Publication No. 0453033A1 discloses a display device of this type, as well as a means of attempting to minimise the number of conductive tracks required for producing a maximum number of grey scales by providing an optimum relationship between the ratios of the surface areas of the column electrode tracks and the ratios of the surface areas of the row electrode tracks.

Alternatively the elements may be binary weighted, by addressing each element in subframes of different durations, for example durations in the ratio 1:4, in a TD technique. European Patent Publication No. 0261901A2 discloses a method of maximising the number of grey levels that can be obtained from a certain number of binary temporal divisions of the addressing frame by dividing the addressed rows of the display matrix into groups and addressing the groups sequentially.

For the case where one form of digital dither (either SD or TD) is used exclusively, the number of grey levels achieved for b bits of dither is $2^b$, where the optimum distribution dither weightings are $2^0$: $2^1$: $2^2$ . . . $2^{b-1}$.

European Patent Publication No. 0478043A1 discloses a method of producing a large number of grey levels by combining spatial dither with an analogue switching arrangement so that at least one of the subelements of each element has more than two switching states, that is a black state 0, a white state 1 and at least one intermediate state having a grey level between 0 and 1. For example, each element may be divided into four (column) subelements having widths in the ratio of 4:2:1:1, each of the subelements being switchable between the black state 0 and the white state 1 except for one of the two smallest subelements which is switchable between four analogue states corresponding to 0, ⅓, ⅔ and 1. Taking account of the relative surface areas of the four subelements, it is possible to obtain a total of thirty-two different grey levels by combining the switching of the four spatial bits with appropriate selection of the different analogue states of the smallest subelement having the four states 0, ⅓, ⅔ and 1. Provision of such an additional spatial bit having more than two analogue states allows further intermediate grey levels to be produced, and the fact that the spatial bit is a bit of small size means that any errors in the analogue levels are not magnified. However such an arrangement leads to additional circuit complexity and cost, and there are difficulties in manufacturing devices, particularly colour display devices, in which a very high density of electrode tracks is required to address the required subpixels.

European Patent Publication No. 0361981 discloses a method of maximising the number of grey levels that can be obtained from a certain number of subpixels in a SD arrangement by dividing each pixel up into n subpixel groups having surface areas in the ratio A1:A2 . . . : $An=m^{n-1}: m^{n-2} \ldots 1$ where m represents the number of grey levels of each subpixel. Where each subpixel has only two grey levels, that is black and white, and there are three subpixel groups, therefore, the optimised ratio of the surface areas of the subpixel groups is 4:2:1, for example. Different optimised ratios are obtained if each pixel group has more than two grey levels or if more subpixel groups are provided. However such an arrangement may again be limited in its application due to difficulties in manufacturability or manufacturing costs considerations.

W. J. A. M. Hartmann, "Ferroelectric liquid crystal displays for television application", Ferroelectrics 1991, Vol. 122, pp. 126, discloses certain optimum combinations of SD and TD ratios for use in ferroelectric liquid crystal display devices to obtain a large number of spaced grey levels. This reference also describes various methods of achieving different analogue grey states such as the texture method in which variation in the texture of the liquid crystal material in dependence on the applied electric field is made use of to obtain different grey levels.

Furthermore U.S. Pat. No. 4,712,877 discloses a method of producing discrete grey states within a pixel of a ferroelectric liquid crystal display device by a technique called multi-threshold modulation (MTM), generally by variation of the electric field over the pixel area. For example the liquid crystal thickness may be varied over the pixel area in steps. This method may be combined with dither techniques in order to produce a large number of grey levels, although in practice it is difficult to address more than a few MTM grey states.

There are a number of inherent physical problems encountered in ferroelectric liquid crystal display devices which result in finite errors in the analogue grey states, and which can accordingly result in unpredictable variation of grey levels with time and/or over the display area. Such problems are discussed in P. Maltese, "Advances and problems in the development of ferroelectric liquid crystal displays", Mol. Cryst. Liq. Cryst. 1992, Vol. 215, pp. 57–72, as well as in K -F. Reinhart, "Addressing of ferroelectric liquid crystal matrices and electrooptical characterisation", Ferroelectrics 1991, Vol.113, pp. 405–417. As is well known, analogue grey states are highly temperature dependent, and the latter reference gives an example in which the display temperature should be uniform to 0.2 degrees if 16 grey levels are required. Both references indicate that the use of thin film transistors for the drive circuitry is advantageous to achieve analogue grey states in such devices.

It is an object of the invention to provide a light modulating device with means for enabling a large number of grey levels to be produced, with the grey levels preferably being spaced apart substantially linearly or in a sequence of desired weightings.

SUMMARY OF THE INVENTION

According to the present invention there is provided a light modulating device comprising an addressable matrix of modulating elements, and addressing means for selectively addressing each element in order to vary the transmission level of the element relative to the transmission levels of the other elements, wherein the addressing means includes spatial and/or temporal dither means for addressing separately addressable spatial bits of each element with different combinations of spatial dither signals and/or for addressing at least part of each element with different combinations of temporal dither signals applied to separately addressable temporal bits corresponding to subframes of different periods to produce a plurality of different transmission levels, and state selection means for switching the spatial and/or temporal bits between different states corresponding to different transmission levels in response to different state switching signals, whereby a plurality of different overall transmission levels are obtainable by selection of different combinations of spatial and/or temporal dither signals and state switching signals, characterized in that the state selection means is adapted to switch at least two bits of each element between more than two different states, at least one bit of each element being switchable between a lesser number of different states than the or each other bit of each element.

The combination of SD and/or TD with analogue grey states (which term may include the black and white states) such that at least two of the bits of each element has three or more different analogue states, and at least one bit of each element has a lesser number of states (such as only two states), means that a larger number of substantially linearly spaced or suitably weighted grey levels can be produced than has previously been possible without giving rise to unacceptable complications. In particular the required number of grey levels, for example 256 grey levels, can be produced without requiring unacceptably complex drive circuitry for addressing the different bits of each element and without introducing unacceptable manufacturing difficulties by requiring electrode tracks to be provided at too great a density. Furthermore the digital dither weighting can be chosen so as to minimize, or preferably remove altogether, any redundancy in the overall grey levels whilst maintaining the desired grayscale progression.

Considering the case of a display device comprising an addressable matrix of pixels addressable by row and column electrodes in an SD arrangement, each pixel may be subdivided into three or more subpixels which may be separately addressable by spatial dither signals so that the overall transmission level of the pixel corresponds to the spatial average of the transmission levels of the subpixels, taking into account the relative areas of the subpixels. As is well known a colour pixel of a colour display device generally comprises three subpixels, that is a red subpixel, a green subpixel and a blue subpixel, which are controllable by separate subelectrodes to enable the full range of colours to be displayed, and, when such an SD arrangement is applied to a colour pixel, each of the colour subpixels is itself sub-divided into three or more subelements to which separate spatial dither signals can be supplied by corresponding subelectrodes so as to allow for a range of transmission levels for each colour. Alternatively or additionally a TD arrangement may be applied to each colour subpixel so that each colour subpixel is addressed within two or more sub-frames by temporal dither signals which may be varied to produce a range of transmission levels. Thus, where reference is made to "pixels" in the following description, it should be understood that this may either be an individual pixel of a non-colour display device or an individual colour subpixel of a colour display device.

In order to provide the required large number of grey levels, such as 256 grey levels for example, a bit may be provided having a large number of analogue states, such as a least significant bit having 8 analogue states in an SD arrangement in which the bits are weighted in the ratios 7(8):8(2):16(2):32(2):64(2):128(2) where the numbers in brackets denote the number of different states in each bit. This provides 256 grey levels using 6 digital bits. However a much lower number of digital bits can be used to produce the same number of grey levels without requiring more than eight analogue states in a given bit (bearing in mind that more than 8 analogue states may give rise to unacceptable errors or unacceptably high drive circuit costs). For example the required 256 grey levels may be obtained by providing two bits having a high number of analogue states, for example 8 analogue states, and a further bit having a lesser number of states, such as 3 bits having relative weightings 7(8):56 (8):193(4) where the numbers in brackets denote the numbers of states in the bits. Many other examples may be given in accordance with the invention in which at least two of the bits have more than two states and at least one other bit has a lesser number of states so as to allow a large number of grey levels to be produced using a relatively small number of bits and without introducing unacceptable errors or drive circuit costs by providing too many states in any given bit.

The invention also provides a light modulating device comprising an addressable matrix of modulating elements, and addressing means for selectively addressing each element in order to vary the transmission level of the element relative to the transmission levels of the other elements, wherein the addressing means includes spatial and/or temporal dither means for addressing separately addressable spatial bits of each element with different combinations of spatial dither signals and/or for addressing at least part of each element with different combinations of temporal dither signals applied to separately addressable temporal bits corresponding to sub frames of different periods to produce a plurality of different transmission levels, and state selection means for switching the spatial and/or temporal bits between different states corresponding to different transmission levels in response to different state switching signals, whereby a plurality of different overall transmission levels are obtainable by selection of different combinations of spatial and/or temporal dither signals and state switching signals, characterized in that the state selection means is adapted to switch at least one of the more significant bits of each element between a greater number of states than at least o ne other bit of each element.

The combination of SD and/or TD with analogue grey states (which term may include the black and white states) such that at least one of the more significant bits, preferably at least the most significant bit, of each element is switchable between a greater number of states than at least one other bit has the advantage that a larger number of substantially linearly spaced or suitably weighted grey levels can be produced than has previously been possible without giving rise to unacceptable complications, particularly in a SD arrangement in which splitting of each pixel into a large number of subpixels can introduce considerable complications in terms of the number of electrode tracks required to be connected to the subpixels and the complexity of the drive circuitry for addressing of the subpixels.

BRIEF DESCRIPTION OF THE DRAWINGS

In order that the invention may be more fully understood, a number of different embodiments in accordance with the invention will now be described, by way of example, with reference to the accompanying drawings, in which:

FIGS. 3, 4, 5*a* and 5*b* are explanatory diagrams showing possible waveforms used in such an addressing arrangement and illustrating temporal dither (TD) and spatial dither (SD) techniques;

FIGS. 6 and 7 are tables showing the grey levels obtainable using known addressing schemes;

FIG. 7 is a table showing the grey levels obtainable using an embodiment of the invention; and FIGS. 8 to 28 are tables showing the grey levels obtainable in further embodiments of the invention.

DETAILED DESCRIPTION OF THE DRAWINGS

Figure 1:
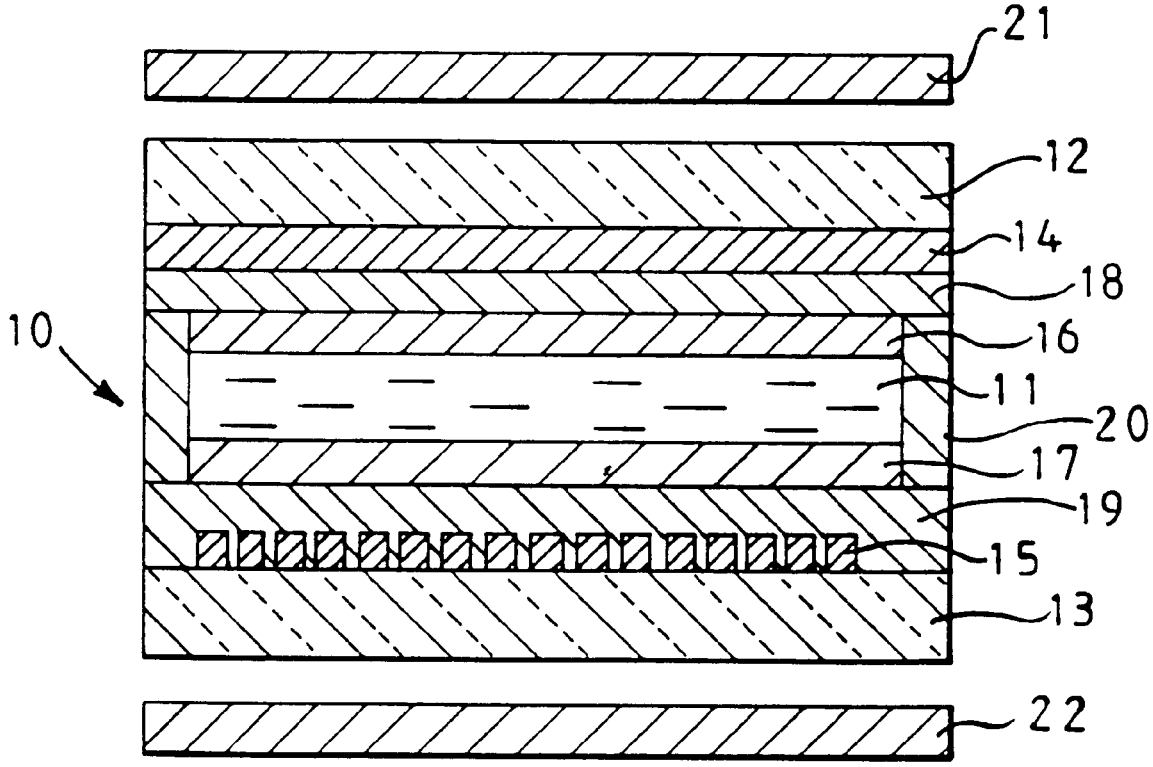
FIG. 1 is a diagrammatic section through a ferroelectric liquid crystal display pixel.

Each of the embodiments to be described comprises a large ferroelectric liquid crystal display (FLCD) panel 10, shown diagrammatically in FIG. 1, comprising a layer 11 of ferroelectric liquid crystal material contained between two parallel glass substrates 12 and 13 bearing first and second electrode structures on their inside surfaces. The first and second electrode structures comprise respectively a series of column and row electrode tracks 14 and 15 which cross one another at right angles to form an addressable matrix of modulating elements (pixels). The electrode tracks may alternatively be arranged to form a polar coordinate (r, θ) matrix, a seven bar numeric matrix or some other x-y matrix. Furthermore alignment layers 16 and 17 are provided on insulating layers 18 and 19 applied on top of the row and column electrode tracks 14 and 15, so that the alignment layers 16 and 17 contact opposite sides of the ferroelectric liquid crystal layer 11 which is sealed at its edges by a sealing member 20. The panel 10 is disposed between polarisers 21 and 22 having polarising axes which are substantially perpendicular to one another. However it will be understood that such a FLCD constitutes only one type of light modulating device to which the invention is applicable, and the following description of such a display is therefore to be considered as being given only by way of non-limiting example.

As is well known, the elements or pixels at the intersections of the row and column electrode tracks are addressable by the application of suitable strobe and data pulses to the row a nd column electrodes. One such addressing scheme, which can be used to discriminate between two states, such as black and white, is disclosed in "The Joers/Alvey Ferroelectric Multiplexing Scheme", Ferroelectrics 1991, Vol.122, pages 63 to 79. Furthermore each pixel, or each subelement of each pixel where the pixel is sub-divided into two or more subelements, has n different analogue grey states dependent on the voltage waveform applied to switch the pixel or subelement, so that, in addition to the black state B and the white state W referred to above, the pixel or subelement has one or more intermediate grey states G.

Figure 2:
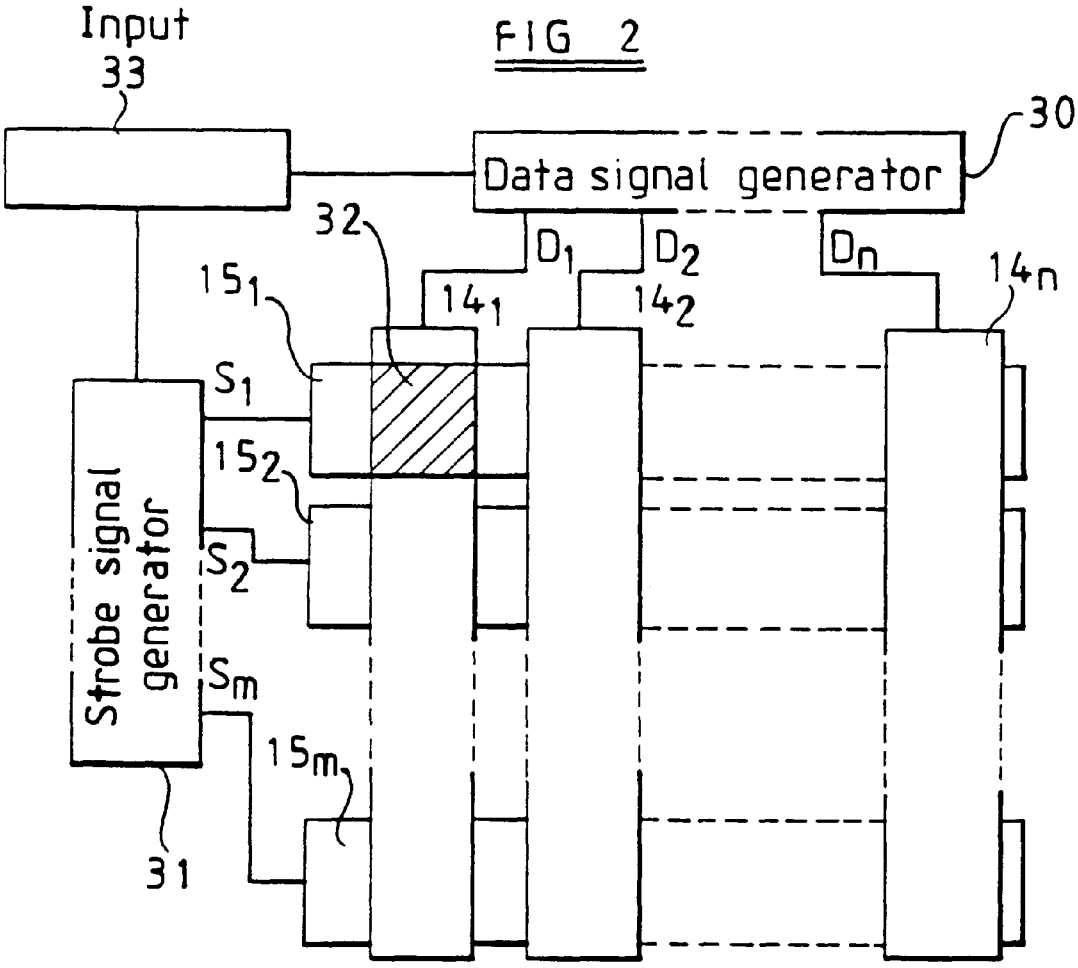
FIG. 2 is a schematic diagram of an addressing arrangement for such a panel.

FIG. 2 diagrammatically shows an addressing arrangement for such a display panel 10 comprising a data signal generator 30 coupled to the column electrode tracks $\mathbf{14}_1$, $\mathbf{14}_2$, . . . $\mathbf{14}_n$ and a strobe signal generator 31 coupled to the row electrode tracks $\mathbf{15}_1$, $\mathbf{15}_2$, . . . $\mathbf{15}_m$. The addressable pixels 32 formed at the intersections of the row and column electrode tracks are addressed by data signals $D_1$, $D_2$ , . . . $D_n$ supplied by the data signal generator 30 in association with strobe signals $S_1$, $S_2$, . . . $S_m$ supplied by the strobe signal generator 31 in known manner in response to appropriate image data supplied to the data signal generator 30 and clock signals supplied to the data and strobe signal generators 30 and 31 by a display input 33 which may incorporate spatial and/or temporal dither control circuitry for effecting spatial and/or temporal dither as referred to with reference to FIGS. 4 and 5 below.

Figure 3:
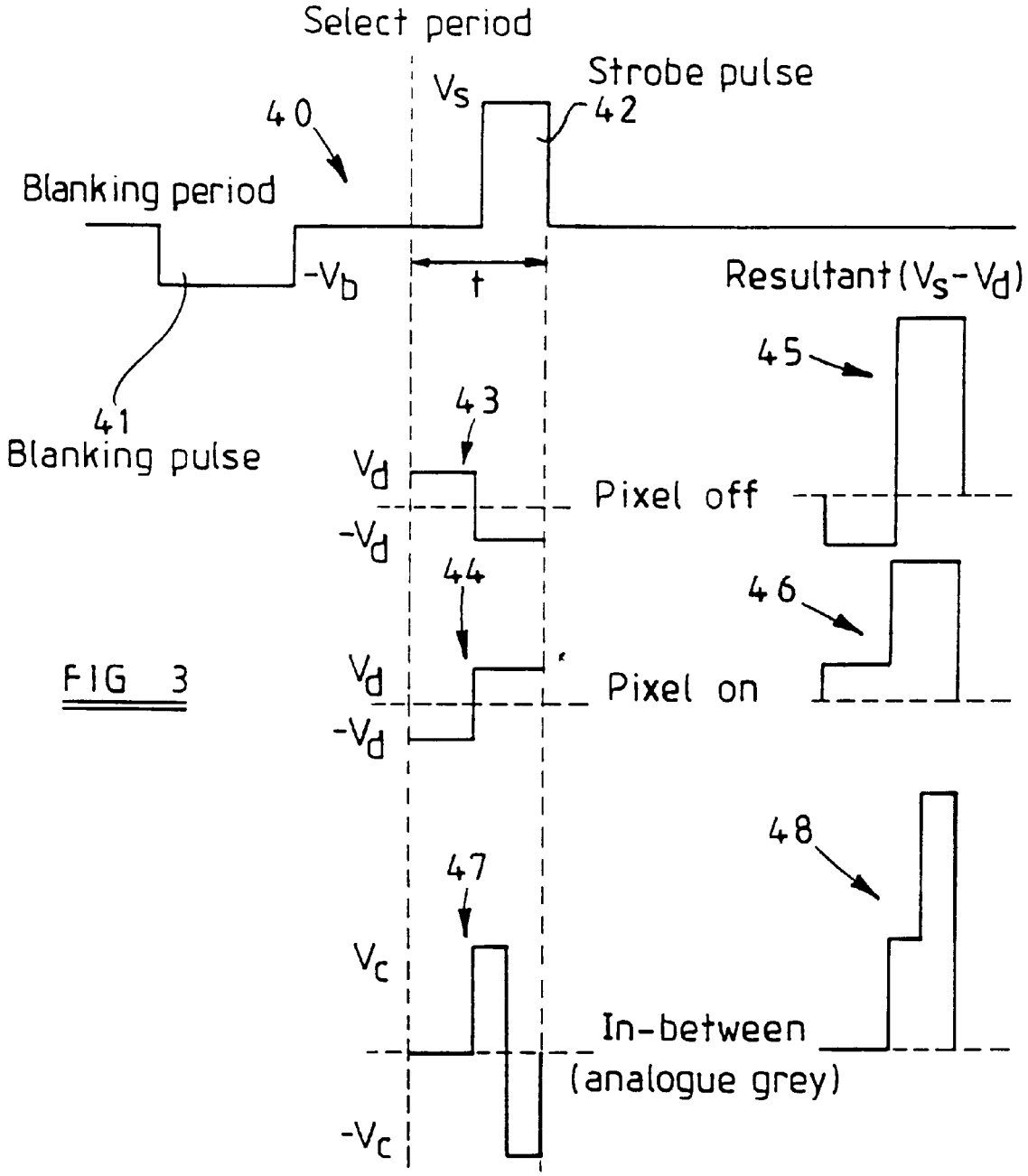

The manner in which the waveforms of the data and strobe signals supplied to particular column and row electrode tracks may determine the switching state of a pixel will now be briefly described with reference to FIG. 3 by way of non-limiting example. FIG. 3 shows a typical strobe waveform 40 comprising a blanking pulse 41 of voltage $-V_b$ in a blanking period and a strobe pulse 42 of voltage $V_s$ in a select period of duration, as well as a typical "off" data waveform 43 and a typical "on" data waveform 44 each comprising positive and negative pulses of voltage $V_d$ and $-V_d$. When the blanking pulse 41 is applied to the pixel, the pixel is switched to, or retained in, the normally black state or the normally white state independent of the data voltage applied to the column electrode track (the particular state being dependent on whether white or black blanking is applied). During the select period, the strobe pulse 42 is applied in synchronism with either the "off" data waveform 43 or the "on" data waveform 44 so that the resultant voltage across the pixel determines the state of the pixel and hence the transmission level. When the "off" data waveform 43 is applied, the resultant voltage 45 across the pixel causes the pixel to remain in the same state, that is the state to which the pixel has previously been blanked by the blanking pulse 41, and, when the "on" data waveform 44 is applied, the resultant voltage 46 across the pixel causes the pixel to switch to the opposite state. Furthermore an intermediate data waveform 47, for example of the form shown in FIG. 3 having positive and negative pulses of voltage $V_c$ and $-V_c$, may be applied to the pixel to produce a resultant voltage 48 across the pixel which causes the pixel to assume an intermediate state corresponding to an intermediate analogue grey level.

Figure 4:
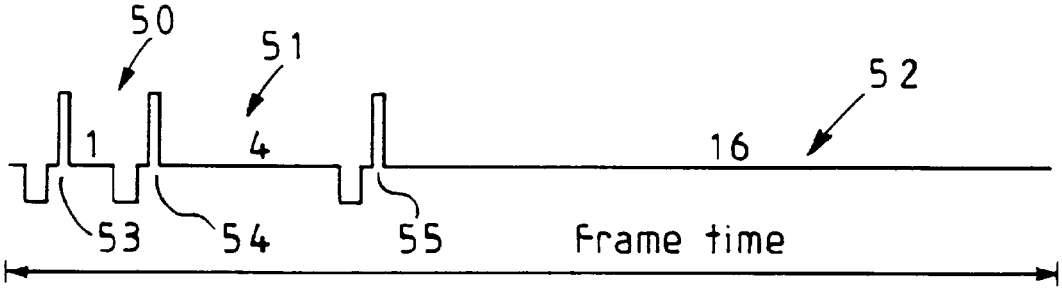
Figure 5A:
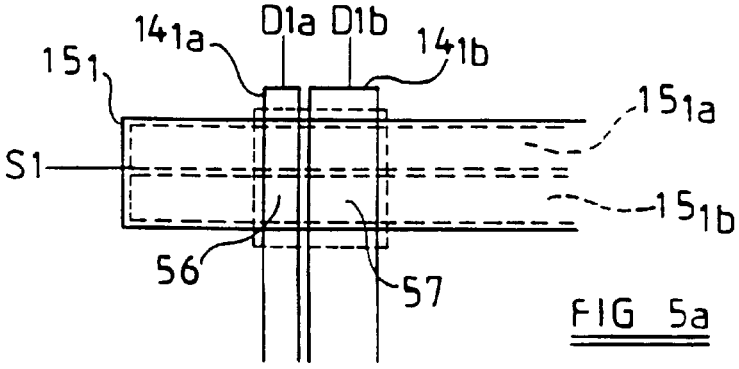

Reference will now be made to FIGS. 4 and 5 to explain possible temporal and spatial dither techniques which may be used in the addressing arrangement to obtain perceived digital grey levels in addition to the analogue grey levels obtainable by application of intermediate data waveforms such as 47 referred to above with reference to FIG. 3. FIG. 4 illustrates the timing of strobe signals 50, 51 and 52 applied to a particular row electrode track to achieve temporal dither during a frame time by defining three select periods 53. 54 and 55 in the ratio 1:4:16, for example, in which the pixel can be switched to the black state, the white state or any intermediate analogue grey state as described with reference to FIG. 3 above. The perceived overall grey level within the frame is the average of the transmission levels within the three subframes defined by the select periods 53, 54 and 55. FIG. 5*a* shows a spatial dither arrangement given by way of non-limiting example in which each pixel comprises two subpixels 56 and 57 formed, for example, by the crossing points of column subelectrode tracks $\mathbf{14}_{1a}$, $\mathbf{14}_{1b}$, with the row electrode track $\mathbf{15}_1$. Data signals $D_{1a}$, $D_{1b}$ are independently applied to the subelectrode tracks $\mathbf{14}_{1a}$, $\mathbf{14}_{1b}$ to independently control the transmission levels of the two subpixels, and the average of the transmission levels of the two pixels and the ratios of the areas of the pixels determine the overall transmission level of the total pixel.

FIG. 5*a* also shows, in broken lines, a possible variant in which, in place of a one-dimensional SD arrangement as described in which each pixel is subdivided into two or more subpixels along the rows, a two-dimensional arrangement is provided in which each pixel is also subdivided along the columns so that each subpixel 56 or 57 is itself divided into two or more subpixels at the intersections of row subelectrode tracks $\mathbf{15}_{1a}$, $\mathbf{15}_{1b}$ with the column subelectrode tracks $\mathbf{14}_{1a}$, $\mathbf{14}_{1b}$. Such two-dimensional SD may be used to increase the number of grey levels obtainable. Furthermore, as already explained above, the SD arrangement may be applied to each of the colour subpixels of a colour pixel so that all references below to pixels may alternatively refer to the colour subpixels of a colour pixel.

Figures 5B, 6:
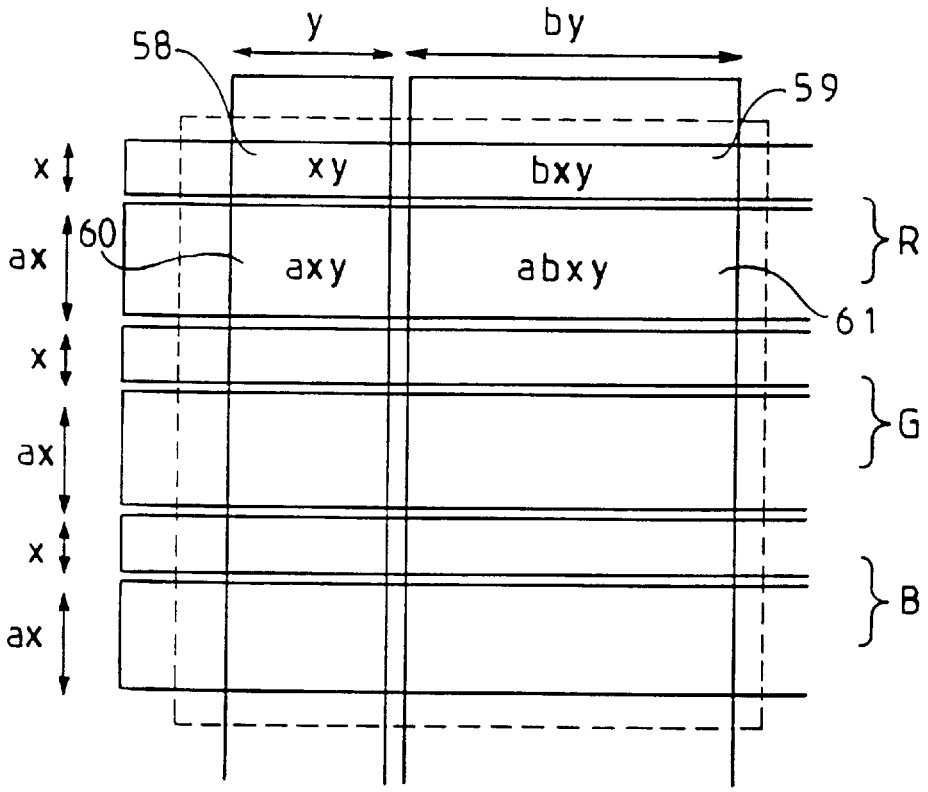

FIG. 5*b* shows another variant in which each pixel is subdivided along the columns into three colour subpixels R, G and B, each colour subpixel being subdivided in two dimensions, that is along the rows in the ratio y:by and along the columns in the ratio x:ax so as to provide, for each colour, four subpixels 58, 59, 60 and 61 having areas in the ratio xy:bxy:axy:abxy. Thus, if a and b are not equal, four different weightings are provided by the subpixels 58, 59, 60 and 61 and it is possible to produce sixteen different grey levels for each colour by switching of different combinations of these subpixels. Furthermore, for each colour subpixel, only two subelectrode tracks are required along each of the two dimensions, that is along the rows and along the columns.

In one possible addressing arrangement, each pixel is divided into three subelements arranged side-by-side and having surface areas in the ratio 9:3:1 in a one-dimensional SD arrangement (without TD), each subelement being separately switchable between three different linearly spaced analogue grey states, that is between a black state corresponding to a unit grey level of 0, a white state corresponding to a unit grey level of 1, and an intermediate grey state corresponding to a unit grey level of 0.5. 27 different linearly spaced total grey levels are obtainable without redundancy by combining the grey levels of the three subelements with appropriate digital weightings. This contrasts, for example, to an arrangement in which the three subelements have surface areas in the ratio 4:2:1 in which a large degree of redundancy is introduced by the intermediate grey levels and fewer overall grey levels are provided than in the 9:3:1 case.

More generally, if each pixel is divided into b subelements in a one-dimensional SD arrangement (without TD), each of which is separately switchable between n different linearly spaced analogue grey states, the subelements have surface areas which are preferably weighted in the ratio $n^0:n^1 \ldots n^{b-1}$ to provide a maximum of $n^b$ different linearly spaced total grey levels without redundancy. For example, where there are three different analogue grey states, the surface areas of the subelements are preferably weighted in the ratio $1:3 \ldots 3^{b-1}$, and, where there are four different analogue grey states, the surface areas of the subelements are preferably weighted in the ratio $1:4 \ldots 4^{b-1}$. Similar digital weightings may be applied to an arrangement utilising TD rather than SD. Different grey levels may be chosen if the greyscale progression is required to be non-linear, for example logarithmic.

In a first embodiment of the invention, each pixel comprises three subelements arranged side-by-side in a one-dimensional SD arrangement (without TD) and having surface areas in the ratio 16:2:1. However, only the largest of the three subelements (that is the most significant bit) has more than two analogue grey states, in this example five linearly spaced analogue grey states 0, 0.25, 0.5, 0.75 and 1 (giving levels of 0, 4, 8, 12 and 16 when weighted by the factor 16) where 0 corresponds to the black state and 1 corresponds to the white state, the other two subelements having only unit grey states of 0 corresponding to the black state and 1 corresponding to the white state. This enables a maximum, of $2^2 \times 5 = 20$ different linearly spaced total grey levels to be obtained, as shown in FIG. 7, whilst restricting the drive circuitry required for the device by virtue of the fact that only one of the subelements of each pixel requires the application of multiple voltage levels thereto for switching between the different analogue grey states. Since only the largest subelement has multiple grey states, the number of such grey levels may be maximised (multiple grey levels being more easily obtainable in the largest subelement) whilst keeping the cost of the associated drive circuitry within reasonable bounds. Since different data waveforms and voltage levels are required for switching the different analogue grey states, the overall cost of the drive circuitry is reduced if the number of states is not the same in all bits, only one of the bits of some of the bits having a greater number of analogue levels requiring a multiplicity of data waveforms and voltage levels. Similar cost advantages are obtainable by such restriction of the drive circuitry in the alternative arrangements where either only TD is used (and not SD) or TD and SD are combined.

Many more examples can be given where more than one of the bits has more than two analogue grey states (one of those bits or a further bit having a lesser number of grey states than the or each other bit) and/or where one or more of the more significant bits has the largest number of analogue grey states. This may help to reduce the cost of driving circuitry as stated above or may have other advantages in certain applications. For example, a large number of analogue grey states may be difficult to obtain reproducibly in the smallest spatial bit where the number of domains used to obtain the analogue grey states is relatively small. Thus it may be preferable to restrict the analogue greyscale to the most significant spatial bit, or the more significant spatial bits, or to spread the analogue greyscale over two or more spatial bits. Alternatively, the number of analogue grey states obtainable may change systematically from one digital bit to the next. Thus, if three digital bits are provided, 256 different total grey levels may be obtained from $256 = 2 \times 8 \times 16$ where the least significant bit has two analogue grey states (0, 1), the second bit has eight analogue grey states (0, 2, 4, 6, 8, 10, 12, 14) and the most significant bit has sixteen analogue grey states (0, 16, 32, 48, 64, 80, 96, 112, 128, 144, 160, 176, 192, 208, 224, 240).

Appropriate distribution of the analogue grey states between the digital bits may allow digital errors to be minimized. For example manufacturing error associated with etching subpixels small size means that accurate of the spatial dither ratios may be difficult. Similarly the addressing of a display with a certain number of lines may not allow perfect temporal dither ratios to be achieved. Another type of digital error arises when adjacent bits (in space or time) have different grey levels, with the result that the transition from one grey level to another leads to an incorrect grey level being observed due to the averaging effect of the eye. Such a transient digital temporal error is referred to by K. Toda et al. (1996) Proceedings of Eurodisplay '96, pp. 39–42, and may be referred to as "pseudoedge". In the case of spatial dither errors, it is anticipated that the smaller the subpixel the larger percentage error caused by manufacturing difficulties. By use of the present invention the distribution of analogue levels between the different bits may be chosen so that the spatial or temporal dither ratios are as low as possible t minimise digital errors. For example, the most significant temporal bit, or the more significant temporal bits, may be made as short as possible, whilst achieving the desired number of total grey levels at low cost, in order to reduce the pseudoedge effect.

As indicated above, further examples can be given in which, instead of one-dimensional SD (1 SD) without TD applied to either the rows or columns, either TD (without SD) or TD combined with SD applied to either the rows or columns or two-dimensional SD (2 SD) applied to the rows and columns simultaneously may be used. Furthermore different combinations of SD and TD may be combined, such as TD+1 SD or TD+2 SD (in which case three digital dimensions are provided). The most practical arrangement for any particular application will depend on factors such as the space available for the electrodes for addressing each pixel, the permitted drive circuitry complexity, the number of grey levels required, ease of manufacture, yield and the like.

Where n analogue grey states are used in an arrangement utilizing both TD and SD, the maximum number of grey levels obtainable is $n^{a \times b}$, with the optimum weightings being given by $n^0 : n^1 : \ldots n^{a-1}$ and $n^0 : n^2 : n^{2a} : n^{3a} \ldots n^{(b-1)a}$ where a is the number of bits of TD (or SD) and b is the number of bits of SD (or TD). For example three analogue grey states (n=3) with 2 bits of SD (a=2) and 3 bits of TD (b=3) give 729 different total grey levels if the weightings are SD=1:3 and TD=1:9:81. Five analogue grey states give 244,140,625 (i.e. $5^{3 \times 4}$) different total grey levels with 3 bits of SD (or TD) and 4 bits of TD (or SD) if the weightings are in the ratio SD (or TD)=1:5:25 and TD (or SD)=1:125:15, 625:1,953,125. The optimum weightings enable linearly spaced grey levels to be obtained without redundancy. However it should be understood that other embodiments are contemplated within the scope of the invention in which weightings are used which ensure that the level of redundancy is reduced to an acceptable level having regard to practical constraints, but in which some redundancy is still provided, that is in which, for at least one transmission level, the same transmission level is obtainable by different combinations of analogue grey states with the digital bits.

Where only one type of digital dither is used, that is TD or one-dimensional SD (for example SD along either the rows or the columns of a display having pixels arranged in rows and columns), each temporal or spatial bit may be switchable between a number of different linearly spaced grey states denoted by $n_1, n_2, n_3 \ldots n_i$ where i is the number of digital bits and $n_i$ represents the number of states of the corresponding bit. In this case the maximum number of total grey levels that can be achieved without redundancy and with the desired distribution of grey levels is:

$$N_{max}=n_1\times n_2\times n_3 \ldots \times n_i$$

which is achieved if the digital bits (duration of subframes in the case of TD or surface areas of subelements in the case of SD) are weighted in the ratio:

$$(n_1-1):n_1(n_2-1):n_1n_2(n_3-1):\ldots n_1n_2n_3\ldots n_{i-1}(n_i-1)$$

In one embodiment of the invention, a SD arrangement is provided having three digital bits, that is a least significant bit having two analogue grey states, a second significant bit having three analogue grey states and a most significant bit is having four analogue grey states (which may be expressed i=3, $n_1$=2, $n_2$=3 and $n_3$=4). In this case the maximum number of linearly spaced total grey levels which can be obtained is 2×3×4=24 if the SD bits are weighted in the ratio 1:4:18. The total grey levels obtainable by such an arrangement are shown in the table of FIG. 8 in which the two states of the least significant bit are 0,1, the three states of the second significant bit are 0,0.5,1, and the four states of the most significant bit are 0,0.33,0.67,1. It is also possible to provide such an arrangement having only two bits where each bit has more than two analogue grey states and one bit has more grey states than the other bit, for example two bits having grey states $n_1$=6, $n_2$=5.

Furthermore the same number of total grey levels may be obtained in an alternative embodiment in which three SD bits are again provided, but the numbers of analogue grey states are allotted in the reverse order, that is so that the least significant bit has four states, the second significant bit has three states and the most significant bit has only two states (which may be expressed i=3, $n_1$=4, $n_2$=3 and $n_3$=2) provided that the bits are now weighted in the ratio 3:8:12 (that is 1:2.67:4). The total grey levels obtainable with such an embodiment are shown in the table of FIG. 9, and in this case the four states of the least significant bit are 0, 0.33, 0.67, 1, the three states of the second significant bit are 0,0.5,1 as in the previous embodiment, and the two states of the most significant bit are 0,1. By enabling the most significant bit to have the least number of analogue grey states, such an embodiment allows digital errors to be reduced. Such digital errors may be particularly noticeable in a displayed image if the most significant bit (or most significant bits) is large, that is of large size in the case of SD or long duration in the case of TD. Since the 0 and 1 states will not be affected by such errors, it follows that the effect of such digital errors will be reduced if only the lower significant bits are chosen to have high numbers of analogue grey states.

FIG. 10 shows a further embodiment having six digital bits with the first two bits having the states 0, 0.5, 1 and the next four bits having the states 0, 1 (i=6, $n_1=n_2=3$, $n_3=n_4=n_5=n_6=2$) and with the bits weighted in the ratio 2:6:9:18:36:72, so that 144 grey levels are achievable. In FIG. 10 the states of the bits are shown unnormalised, that is with the appropriate weighting, so that the states of the first two bits are shown as (0, 1, 2) and (0, 3, 6) whereas the states of the other four bits are shown as (0, 9), (0, 18), (0, 36) and (0, 72).

In a further embodiment digital dither is applied in two dimensions, such as TD combined with SD on the rows only, or SD on the rows combined with SD on the columns. In such an embodiment, different numbers of analogue grey states may be provided in the corresponding bits of the two digital dimensions. For simplicity, the case may be considered where the same numbers of analogue grey states are provided in the corresponding bits of both digital dimensions. For example, in the case of TD combined with SD on the rows only, the first temporal bit may have $n_1$ analogue grey states and the second temporal bit may have $n_2$ analogue grey states in the first dimension, and the same states may be provided in the second dimension, so that the second spatial bit has $n_1$ and $n_2$ analogue grey states in the first and second temporal bits also.

Expressed generally and considering two dimensions of digital dither, one with i bits of various numbers $n_1, n_2, n_3 \ldots n_i$ of analogue grey states and the other with j bits of corresponding numbers $n_1, n_2, n_3 \ldots n_j$ of analogue grey states, the optimum weightings are:

$(n_1-1):n_1(n_2-1):n_1n_2(n_3-1):\ldots n_1n_2n_3\ldots n_{i-1}(n_1-1)$ in one dimension, and $1:n_1n_2n_3\ldots n_{i-1}n_i:n_1^2n_2^2n_3^2\ldots n_{i-1}^2n_i^2:\ldots n_1^{j-1}n_2^{j-1}n_3^{j-1}\ldots n_{i-1}^{j-1}n_i^{j-1}$ in the other dimension and the total number of grey levels available is $n_1^jn_2^jn_3^j\ldots n_i^j$ It should be noted that the same numbers of analogue grey states are used in each bit of the j dimension as are used in the corresponding bit of the i dimension. These expressions apply if i (the dimension with different numbers of analogue grey states in each bit) is equal to or greater than j (the dimension in which the number of analogue grey states in each bit is the same as in the corresponding bit of dimension i). However weightings other than these weightings are contemplated within the scope of the invention as practical considerations may mean that weightings are chosen which give some redundancy of grey levels.

In one example of such a two-dimensional arrangement, four bits of TD are used in combination with two bits of SD (i=4, j=2) where, for the first spatial bit, the least significant temporal bit has five analogue grey states, the next least significant temporal bit has three analogue grey states and the two most significant temporal bits have only two states, namely the states 0 and 1 (which may be expressed i=4, j=2, $n_1$=5, $n_2$=3, $n_3=n_4$=2). Furthermore each temporal bit of the second spatial bit has the same number of analogue grey states as the corresponding temporal bit of the first spatial bit. In this case the maximum number of grey levels possible is $5^2\times3^2\times2^2\times2^2$ x=3600, and this is obtained if the temporal weightings are 4:10:15:30 (that is 1:2.5:3.75:7.5) and the spatial weightings are 1:60 (=5×3×2×2). In another embodiment i and j may be interchanged between the temporal and spatial dimensions, giving, for example, i=2, j=4, $n_1$=5, $n_2$=3, $n_3=n_4$=2. This gives Nmax=160,000 if the temporal bits are weighted in the ratio 4:10 and the spatial bits are weighted in the ratio 1:15:225:3375.

If consideration is now given to possible combinations of numbers of analogue grey states in a two-dimensional arrangement in which only the least significant bit has a number of analogue grey states greater than 2 the case may be considered in which, in order to achieve Nmax=256, three bits of TD are used in combination with two bits of SD (i=3,j=2) where the least significant bit has $n_1$>2, and other bits have $n_2=n_3$=2. $N_{max}=n_1^j.n_2^j.n_3^j\ldots n_{i-1}^j.n_i^j=n_1^2.2^2.2^2$=256 yields $n_1$=4, and the optimum weightings are 3:4:8 in the temporal dimension and 1:16 in the spatial dimension. Alternatively, for the case of two bits of TD and three bits of SD (i=2, j=3), Nmax=$n_1^3.2^3$=256 so that $n_1$=3.17 and $n_1$ should be made 4 in this example. Thus the optimum weightings are 3:4 in the temporal dimension and 1:8:64 in the spatial dimension in this case, which results in a total of 512 grey levels being obtainable. In this instance, there is a manufacturing advantage to having a spatial weighting in the ratio 3:4 since this means that the smallest spatial bit is larger for a given total pixel area.

Under certain circumstances it is permitted to provide analogue states other than 0 and 1 in the most significant bit in order to obtain the desired total number of grey levels, which is usually close to 256 grey levels in display devices. If three bits of TD are used in combination with two bits of SD (i=2, j=3) and $n_2=n_1$, then $n_1^3.n_1^3=256$ so that $n_1=2.5$. Thus, using three analogue grey states in both spatial bits, the 256 total grey levels are obtainable with optimum weightings in the ratios 2:6 (that is 1:3) SD and 1:9:81 TD. It should be noted that these three analogue grey states occur in all of the subsequent temporal bits.

It should be appreciated that, although it is preferred to select the numbers of digital bits and the numbers of analogue grey states together with their optimum weightings so as to obtain the required number of total grey levels with minimum redundancy of levels where possible, some redundancy of levels can be tolerated in certain applications to suit the particular circumstances, such as for manufacturing reasons. Thus it may be preferable, for manufacturing reasons, to set the bits of SD (or indeed TD) of one dimension to some arbitrary predetermined weighting (which is not necessarily optimum) and to then calculate the optimum weighting for the bits of TD and/or SD of the other dimension or dimensions. For example, consideration may be given to a two-dimensional arrangement where one dimension (such as SD along the columns or rows) has two bits set at the ratio 1:X for ease of manufacture, and the other dimension (such as TD) has two or three bits each of which has n grey states. In this case a suitable choice of digital weightings in the second dimension to give linearly spaced grey levels (assuming that this is what is desired) is:

$$(n-1):X(n-1)^2+n(n-1):(n-1)+\{(n+1)+2nX\}(n-1)^2+X^2(n-1)^3$$

which gives a total of$(X+1).\ [(n-1)+X(n-1)^2+n(n-1)+(n-1)+\{(n+1))+2nX\}(n-1)^2+X^2(n-1)^3]+1$ overall grey levels. This process can of course also be used for higher levels.

A practical example of this might be that 1:2 SD is chosen for reasons of manufacture. It is also possible to arrange for the weightings to be changed in operation of the device in response to operational parameters, for example so that, at temperatures where intermediate analogue states are no longer available, a linear progression of overall grey levels is still possible by changing the required digital weightings back to a simple digital progression.

In other embodiments utilizing a two-dimensional arrangement different numbers of states may be used in each of the bits in one dimension. For example, considering the case where two bits of SD set at the ratio 1:X are combined with three bits of TD, but the first temporal bit has $n_1$ states, the second temporal bit has $n_2$ states and the third temporal bit has $n_3$ states, linearly spaced grey levels are obtained using digital weightings in the second dimension as follows:

$$(n_1-1):\{(n_1-1)(X+1)+1\}.(n_2-1):[\{(n_1-1)+[(n_1-1)(X+1)+1](n_2-1)\}(X+1)+1](n_3-1)$$

If X is set at 2 for a single spatial dither dimension (i.e. 1:2 SD), with 3 bits of temporal dither (3 TD) and different numbers of levels in the temporal bits in the distribution n1=2, n2=2 and n3=6, then 256 linearly spaced grey levels are obtained using temporal dither weighting 1(2):4(2):80(6) as shown in the table of FIG. 11, where the bracketed figures indicate the number of transmission levels in each bit. This combination includes two digital bits with more than two transmission levels, namely the most significant temporal bit for both the least significant and the most significant spatial bits.

A further example in which six levels are used in two bits and two levels used in the remaining four bits, with X set at 2 is shown in FIG. 12. In this case the six transmission levels are used in a different temporal bit to the previous example, and the temporal dither ratios is adjusted according to the teaching of the present invention, that is 1(2):20(6):64(2), also leading to 256 linearly spaced greys. The example of FIG. 12 may be preferable to that of FIG. 11 if the transient digital error pseudoedge is considered overly detrimental to display performance, since the same number of grey levels is achieved but with a shorter duration of the most significant bit. Alternatively, there are some circumstances where the digital error associated with accuracy of achieving the correct temporal weightings for a given number of lines may mean that the example of FIG. 11 has advantage over that of FIG. 12.

FIG. 13 is a third example of X set at 2, with two bits containing six levels and the other four containing two levels only, but with $n_1=6$, $n_2=2$ and $n_3=2$, for the case where no temporal dither is used but the two dimensions of spatial dither are used, namely subpixellation in both the rows and columns in an xy matrix display. This type of arrangement may be preferable if the switching time of the liquid crystal is not sufficiently fast to enable temporal dither. This may occur where the material choice is limited by other factors such as brightness, or low temperature operation, or for applications where a very large number of lines are used (for example in FLC computer generated holograms), or a very fast frame rate required (for example in many spatial light modulators used in optical computing, routing, etc.), or where the time domain is used for frame sequential colour to give very bright displays without colour filters. In the example of FIG. 13, six transmission levels are used in the both bits of the row spatial dither but only in the least significant bit of the column dither. If X is set at 2 for the rows the digital dither used in the columns is 5(6):16(2):64(2) (i.e. the dither ratio is 1:3.2:12.8). This has the advantage that the ratio of the most and least significant bits is lower in this example than in the equivalent examples for FIGS. 11 and 12, and hence the example of FIG. 13 is less susceptible to digital errors, and is easier to manufacture. This is in addition to the driver cost benefit of having a number of levels in the least significant columns only.

FIGS. 14, 15, 16, 17 and 18 show examples where X is again set at 2 for one spatial dimension, (i.e. 1:2 SD) and three bits are used in another dimension (which may be either temporal or spatial) but there are different numbers of transmission levels used in the three bits of the second dimension. That is, there are four levels in one bit, three in another, and two in the remaining bit of that dimension. In each case 280 levels are obtained by using the digital weighting according to the present invention but in each of the cases the distribution of the different numbers of transmission levels is altered. Hence in FIG. 14, 1:2 SD is used in conjunction with 1(2):8(3):84(4), in FIG. 15 with 1(2):12(4):80(3), in FIG. 16 with 2(3):21(4):70(2) (i.e. 1:10.5:35) and in FIG. 17 with 3(4):10(2):80(3) (i.e. 1:3.3:26.7). In FIG. 18, a similar example is given but with two spatial dimensions being used, the second of which has the weightings 3(4):20(3):70(2) (i.e. 1:6.7:23.3). As before the choice may be dictated by considerations such as cost, manufacturability and error.

It is also possible to choose optimum weightings for some of the bits whilst choosing non-optimum values for other bits in order to adapt to other requirements. For example, digital errors such as the pseudoedge and dynamic contour effects, may be reduced if the most significant temporal bit is arranged to be as short as possible. The examples of FIG. 14 to FIG. 18 each led to 280 grey levels. If this is greater than the required level (commonly 256 for moving picture colour displays) then the weightings may be adjusted accordingly. An example of this is shown in FIG. 19. In this example it is the most significant temporal bit which is adjusted so that digital errors are also reduced. In this case it may be acceptable to provide fewer overall grey levels if this causes a reduction in these effects.

FIGS. 20, 21 and 22 illustrate examples with one bit set with X=2, and the weightings of the other dimension of digital dither, either spatial or temporal, are adjusted to maximize the total number of grays possible with three levels used in fur bits, that is two bits of the second dimension, and two levels in two bits, that is one bit of the second dimension. These illustrate similar principles to those described previously, but where only one bit of one dimension has a different number of transmission levels.

A further example of the present invention is shown in FIG. 23, where three digital dither dimensions are used, two spatial and one temporal dimension. FIGS. 24, 25, 26 and 27 each show examples where different numbers of transmission levels are used in different spatial bits, but the same number of levels for a given spatial bit (i.e. subpixel) is used in the different temporal bits. These have the advantage that only one set of subpixels need be provided with means for multiple transmission levels, thereby ensuring cheaper drive circuitry, and possibly manufacturability due to space constraints for the electronics alongside the display.

FIGS. 24 and 25 both show the case for 2 bits of spatial dither and 3 bits of temporal dither, where 5 levels are used in one spatial bit and 2 levels are used in the other. The choice of which of these is acceptable depends on a range of factors. FIG. 25 may be preferable if a large number of total grey levels is required (in this case 1000), and/or the case of manufacture and associated costs require that the spatial dither ratio is kept close to unity, and that these factors are more important than digital errors such as the pseudo edge (associated with the long relative duration of the most significant bit) or error in producing analogue levels (for example due to having the analogue levels in the least significant spatial bit). Alternative, FIG. 24 may be preferable if the reverse is true.

FIG. 28 is a two-dimensional example in which one dimension is set with X=3, and there are different numbers of analogue levels used in individual bits, that is that different numbers of transmission levels are used in each temporal bit and each spatial bit in order to combined the advantages of the various approaches described in previous examples.

Each of the above embodiments utilising TD may be modified by replacing the TD with a second dimension of SD so that, for example, the SD ratios of each of FIGS. 11, 12, 14, 15, 16, 17, 19, 20, 21 and 24 to 28 represent the SD ratios along the rows and the TD ratios represent the SD ratios along the columns.

Further embodiments may also be provided is which 2 SD is combined with 2 TD. Such embodiments may be particularly applicable at lower temperatures where the number of bits of TD available is limited due to the slow switching time of the material. For example, in one such embodiment, the SD is in the ratio of 1:2 and the 2 TD bits are weighted in the ratio 21(22):64(2), where the bracketed figures represent the number of analogue grey states in the bits, in order to obtain a total of 256 grey levels. A further example again uses SD in the ratio of 1:2 but in his case the 2 TD bits are weighted in the ratio 12(13):74(3) in order to obtain a total of 259 grey levels. In a further example the SD is in the ratio 1:2 and the two this case the TD bits are weighted in the ratio 9(10):84(4) in order to obtain a total of 280 grey levels. In a still further example the SD is in the ratio of 1:2 and the two TD bits are weighted in the ratio 8(9):75(4) in order to obtain a total of 250 grey levels.

It may be that X is chosen to maximize the total number of grays within a certain range of operation, for example within a temperature range. At temperatures outside this range the number of available bits of digital dither or the number of available analogue levels may change and so the digital weightings would need to be altered to compensate for such changes. In practice it is only the temporal dither weightings which may be altered in response to a change in conditions. An example of this may be as follows. At elevated operating temperatures the liquid crystal material is sufficiently fast to allow, say, four bits of temporal dither. More than two transmission levels may not be possible, and so two bits of spatial dither would be required to achieve the required total of 256 grays using an all digital option common in the literature such as 1:2 SD: 1(2):4(2):16(2):64 (2) TD. At lower temperatures 3 TD may only be possible and to achieve the required numbers of grays analogue levels must be introduced into some of the bits. The spatial dither weighting cannot be changed in response to the change in conditions and hence X is set at 2. Hence, examples such as those of FIGS. 11, 12 or 13 may be required. At lower temperatures one of the 2 TD options given above would be required.

What is claimed is:

1. A light modulating device comprising an addressable matrix of modulating elements, and addressing means for selectively addressing each element in order to vary the transmission level of the element relative to the transmission levels of the other elements, wherein the addressing means includes spatial and/or temporal dither means for addressing separately addressable spatial bits of each element with different combinations of spatial dither signals and/or for addressing at least part of each element with different combinations of temporal dither signals applied to separately addressable temporal bits corresponding to subframes of different periods to produce a plurality of different transmission levels, and state selection means for switching the spatial and/or temporal bits between different states corresponding to different transmission levels in response to different state switching signals, whereby a plurality of different overall transmission levels are obtainable by selection of different combinations of spatial and/or temporal dither signals and state switching signals, characterized in that the state selection means is adapted to switch each of at least two bits of each element between more than two different states, at least one bit of each element being switchable between a lesser number of different states than other bit or bits of each element.

2. A light modulating device according to claim 1, wherein the state selection means is adapted to switch at least two bits of each element between at least two different states and at least one other bit between a lesser number of states, such as only two states.

3. A light modulating device according to claim 1, wherein the state selection means is adapted to switch said at least two bits of each element between the same number of different states.

4. A light modulating device comprising an addressable matrix of modulating elements, and addressing means for selectively addressing each element in order to vary the transmission level of the element relative to the transmission levels of the other elements, wherein the addressing means includes spatial and/or temporal dither means for addressing separately addressable spatial bits of each element with different combinations of spatial dither signals and/or for addressing at least part of each element with different combinations of temporal dither signals applied to separately addressable temporal bits corresponding to subframes of different periods to produce a plurality of different transmission levels, and state selection means for switching the spatial and/or temporal bits between different states corresponding to different transmission levels in response to different state switching signals, whereby a plurality of different overall transmission levels are obtainable by selection of different combinations of spatial and/or temporal dither signals and state switching signals, characterised in that the state selection means is adapted to switch at least one bit of each element between more than two different states, at least one of the more significant bits of each element being switchable between a greater number of states than at least one other bit of each element.

5. A light modulating device according to claim 4, wherein the state selection means is adapted to switch at least the most significant bit of each element between a greater number of states than at least one other bit of each element.

6. A light modulating device according to claim 5, wherein the state selection means is also adapted to switch the next most significant bit of each element between a greater number of states than said other bit of each element.

7. A light modulating device according to claim 1, wherein the dither means is arranged to address the elements in only one dither dimension, and such that the maximum number of overall transmission levels obtainable by selection of different combinations of spatial or temporal dither signals and state switching signals is $n_1 \times n_2 \times \ldots n_i$, where $n_1, n_2 \ldots n_i$ are the numbers of different states of the bits, 1, 2 . . . i.

8. A light modulating device according to claim 7, wherein the relative weightings of the i bits of dither are in the ratio $(n_1-1):n_1(n_2-1): \ldots n_1 n_2 \ldots n_{i-1}(n_i-1)$.

9. A light modulating device according to claim 1, wherein the dither means is arranged to address each element with i bits of spatial dither and j bits of temporal dither where i and j are integers greater than or equal to 2, each bit being switchable between an integral number of different states greater than or equal to 2.

10. A light modulating device according to claim 1, wherein the dither means is arranged to address each element with i bits of spatial dither along one spatial dimension and j bits of spatial dither along another spatial dimension where i and j are integers greater than or equal to 2, each bit being switchable between an integral number of different states greater than or equal to 2.

11. A light modulating device according to claim 10, wherein the dither means is arranged to further address each element with k bits of temporal dither where k is an integer greater than or equal to 2, each bit being switchable between an integral number of different states greater than or equal to 2.

12. A light modulating device according to claim 9, wherein the dither means is arranged to address each element in two dither dimensions, such that the maximum number of overall transmission levels obtainable by selection of different combinations of spatial and/or temporal dither signals and state switching signals is $n_1^j \times n_2^j \times \ldots n_i^j$ where $n_1, n_2 \ldots n_i$ are the number of different states of the bits and the same number of states are provided in each bit of the one dimension as in the corresponding bit of the other dimension.

13. A light modulating device according to claim 12, wherein the relative weightings of the i bits of dither in the one dimension are $(n_1-1):n_1(n_2-1): \ldots n_1 n_2 \ldots n_{i-1}(n_i-1)$, and of the j bits of dither in the other dimension are $1:n_1 n_2 \ldots n_i: \ldots n_1^{j-1} n_2^{j-1} \ldots n_i^{j-1}$.

14. A light modulating device according to claim 13, wherein the dither means is arranged to address each element in one dimension with two bits of dither with relative weightings 1:X representing a ratio which is chosen for manufacturing reasons, and in the other dimension with an integral number of bits of dither with relative weightings chosen to provide the desired range of overall transmission levels.

15. A light modulating device according to claim 14, wherein three bits of dither are selected in the other dimension having $n_1$, $n_2$ and $n_3$ different states respectively, where $n_1$, $n_2$ and $n_3$ are integers greater than or equal to 2, with relative weightings $(n_1-1):\{(n_1-1)(X+1)+1\}(n_2-1):[\{(n_1-1)+[(n_1-1)(X+1)+1](n_2-1)\}(X+1)+1](n_3-1)$.

16. A light modulating device according to claim 1, wherein the relative weightings of the bits of dither are chosen so as to minimise the redundancy of overall transmission levels obtained by the different combinations of spatial and/or temporal dither signals and state switching signals whilst maintaining the desired greyscale progression.

17. A light modulating device according to claim 1, wherein the dither means is arranged to vary the weightings of the bits of dither in dependence on the temperature of the device.

* * * * *